US007180209B2

(12) United States Patent
Hyde et al.

(10) Patent No.: US 7,180,209 B2
(45) Date of Patent: Feb. 20, 2007

(54) MULTIPLE FUNCTION ELECTRONIC DRIVE

(75) Inventors: Stephen L Hyde, Clarkston, MI (US); Patrick D Dean, Armada, MI (US); Paul F Roach, Grand Blanc, MI (US); Sivapalan Balanayagam, Lasalle (CA)

(73) Assignee: DaimlerChrysler Corporation, Auburn Hills, MI (US)

( * ) Notice: Subject to any disclaimer, the term of this patent is extended or adjusted under 35 U.S.C. 154(b) by 308 days.

(21) Appl. No.: 10/754,034

(22) Filed: Jan. 8, 2004

(65) Prior Publication Data

US 2005/0121982 A1 Jun. 9, 2005

Related U.S. Application Data

(60) Provisional application No. 60/526,838, filed on Dec. 4, 2003.

(51) Int. Cl.
*H01H 3/26* (2006.01)

(52) U.S. Cl. ..... 307/143

(58) Field of Classification Search ..... 307/143
See application file for complete search history.

(56) References Cited

U.S. PATENT DOCUMENTS 4,820,935 A * 4/1989 Gontowski ..... 307/112
5,392,643 A 2/1995 O'Kennedy et al.
6,915,171 B2 * 7/2005 Mayer ..... 700/13

* cited by examiner

*Primary Examiner*—Robert L. Deberadinis
(74) *Attorney, Agent, or Firm*—Ralph E. Smith

(57) ABSTRACT

An electronic drive system using a plurality of drive circuits for enabling greater plurality of functions by selectively placing drive signals on the driver outputs at one of two possible polarities. At least one of the enabled functions taking a substantially shorter time for enablement, thereby allowing at least two of the plurality of functions to share a common driver output enabling signal.

6 Claims, 1 Drawing Sheet

| Driver 1 | 0 | 0 | 1 | 1 |
|---|---|---|---|---|
| Driver 2 | 0 | 1 | 0 | 1 |
| Effect | No Function | Unlock | Lock & Heat | Heat Only |

MULTIPLE FUNCTION ELECTRONIC DRIVE

PRIORITY CLAIM

This application claims the benefit of U.S. Provisional Application No. 60/526,838, filed on Dec. 4, 2003.

FIELD OF THE INVENTION

The present invention relates generally to a multiple function electronic drive system, and more particularly to a system that uses a reduced number of drive circuits to perform multiple functions.

BACKGROUND OF THE INVENTION

Drive circuits are used extensively in automotive and industrial applications for switching power to ground referred loads. For example, in an automotive application, in order to actuate the power lift gate and the rear window defroster in a vehicle, an electronic drive system having a number of drive circuits is required. Currently, two drive circuits are used to enable the two functions of the lift gate and a separate drive circuit is used to enable the function of the rear window defroster. In this case, the two functions of the lift gate include a locking and unlocking function, while the function of the rear window defroster includes a heating function. Altogether, three drive circuits are used to enable the three different functions. With this configuration, enabling the functions of the lift gate and the rear window defroster can be performed independently. However, using separate drive circuits for enabling the three functions can be costly for such applications.

Therefore, there is a need for an electronic drive system that uses a plurality of drive circuits to enable a plurality of functions, wherein the plurality of drive circuits is less than the plurality of functions. In addition, there is a need for an electronic drive system that can enable any one of the plurality of the functions and have negligible effect on the remaining ones of the functions.

SUMMARY OF THE INVENTION

In one aspect of the invention, a method for enabling a first plurality of functions via electrical signals provides a second plurality of drive circuits for providing the electrical signals, wherein the second plurality is less than the first plurality. The functions are selected such that at least one of the functions can be enabled faster than at least one other function. At least one of the drive circuits is used to enable both the at least one function and the at least one other function.

In another aspect of the invention, a driver system for enabling a first plurality of functions includes a second plurality of driver circuits, each operative to generate at an output thereof one of two possible signal polarities depending on a state of the driver circuits. A controller is operative to recognize requests for enabling at least one of the plurality of functions and to place the second plurality of driver circuits in states such that the driver circuit outputs will have appropriate signal polarities for enabling the at least one function requested.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figures 1, 2:
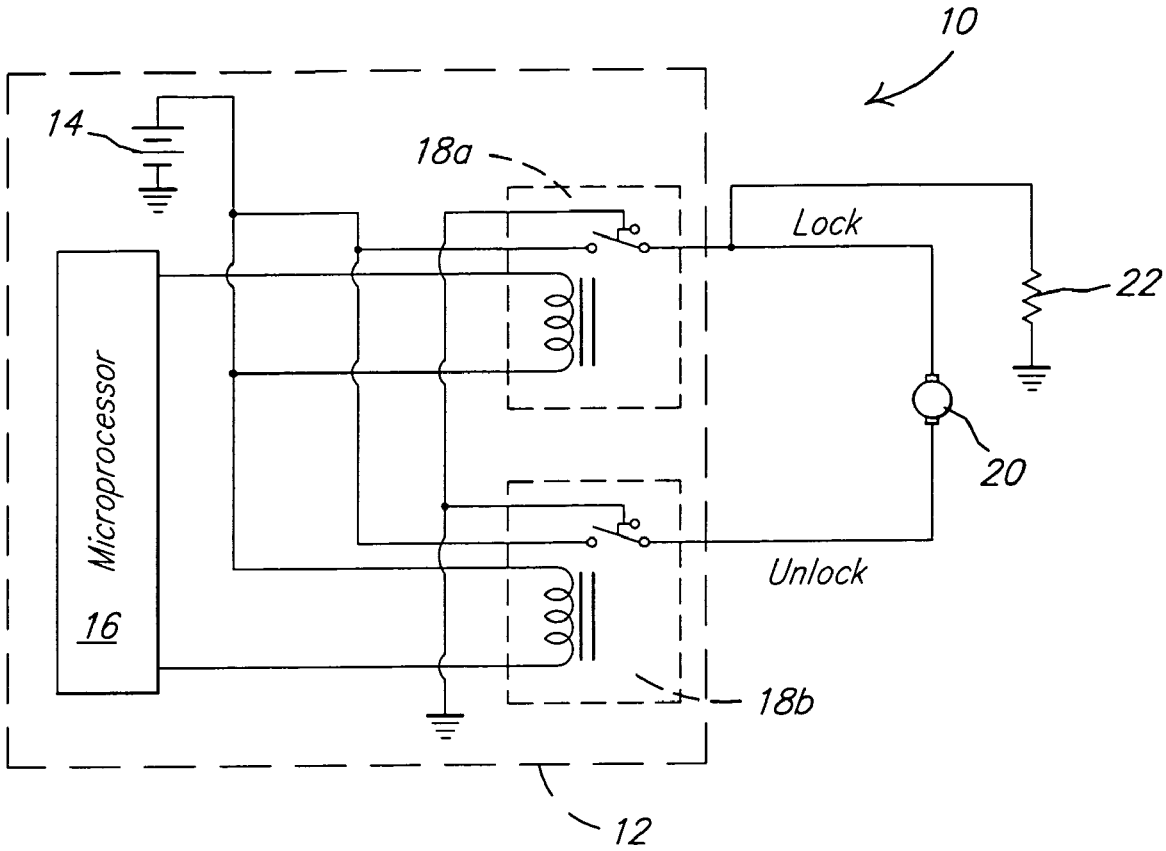
FIG. 1 illustrates a multiple function electronic drive system according to the present invention.
FIG. 2 is a table showing a combination of polarity arrangements for the drive circuits according to the present invention.

The following description is merely exemplary in nature and is in no way intended to limit the invention, its application, or uses.

FIG. 1 illustrates a multiple function electronic drive system 10 for driving a number of functions using a number of drive circuits, wherein the number of drive circuits is less than the number of functions. The system 10 generally comprises an electronic configuration 12 having a power source 14 such as a battery, a microprocessor 16, and two drive circuits 18*a*, 18*b*. The power source 14 is coupled to the microprocessor 16 and the drive circuits 18*a*, 18*b* for generating a flow of current through the drivers 18*a*, 18*b*. In this example, a solenoid 20 and a heating element 22 are electrically coupled to the drivers 18*a*, 18*b*. The solenoid 20 is essentially an electromagnet adapted to move an integral plunger in one of two directions depending upon the direction of current flow through its coil. The heating element 22 is made of a resistive conductor. Specifically, ends of the coil of solenoid 20 are respectively electrically coupled to one of the drivers 18*a*, 18*b*. The heating element 22 is electrically coupled between driver 18*a* and ground. Alternatively, heating element 22 could be coupled between driver 18*b* and ground. The drive circuits 18*a*, 18*b* may each comprise an electromechanical relay switch adapted to open and close, thereby changing the polarity at the potential appearing at the output of each drive circuit 18*a*, 18*b*. It should be understood that the solenoid 20 can be replaced with any type of switch device such as, for example, a reversible motor.

The drive circuits 18*a*, 18*b* are controlled by the microprocessor 16. It should be understood that the microprocessor 16 can be any type of commercially available microprocessor well known in the art for executing instructions. The microprocessor 16 controls the drive circuits 18*a*, 18*b* by energizing and de-energizing the relay's coils, thereby closing and opening the power source contact of each relay and controlling the electrical current flow through the loads 20 and 22. The electrical current is provided by the power source 14. Specifically, the microprocessor 16 is used to reverse the polarities of the potential at the outputs of the drive circuits 18*a*, 18*b*, thereby controlling the functions of the solenoid 20 and the heating element 22. A user in a vehicle typically activates the microprocessor 16 to control the drive circuits 18*a*, 18*b* states by command buttons that may be located in different areas of a vehicle. The drive circuits 18*a*, 18*b* are used to enable the functions of the solenoid 20 and the heating element 22. In this case, the movable plunger of solenoid 20 moves in a first or a second direction depending on the direction of current supplied by drive circuits 18*a*, 18*b*.

The plunger of solenoid 20 is used to move a vehicle door's lock mechanism to locked or unlocked states. As such, when driver 18*a* is closed and driver 18*b* is open, the solenoid plunger moves an associated lock mechanism in a direction locking the door. When the polarities of the voltages at the outputs of the drivers 18*a*, 18*b* are reversed, having driver 18*a* open and driver 18*b* closed, the solenoid plunger moves the associated lock mechanism in a second direction unlocking the door. When the drivers 18*a*, 18*b* are both open, the solenoid 20 is off, thereby keeping the lock state of the door unchanged. In this case, no current is flowing through the solenoid 20. Once the door is locked or unlocked, the drivers 18*a*, 18*b* are switched back into their off state.

The heating element 22 can also be actuated by the drivers 18*a*, 18*b* to either an on or off state. The heating element 22 is used to generate heat for a vehicle side mirror defroster system. The heating element 22 can be actuated in two ways. The first is by operating driver relay 18*a* and opening driver 18*b*. The second is by operating both driver relays 18*a*, 18*b*.

In a first example, when the user wishes to lock the door in the vehicle, the microprocessor 16 operates relay driver 18*a* and keeps relay driver 18*b* off. In doing so, the power source 14 provides a flow of current through driver 18*a* to ground, via the solenoid 20. At this time, current also flows through the heating element 22 to ground. However, when the solenoid 20 is being actuated to lock the door, there is negligible effect on the heating element 22. This is due to the difference between the length of time it takes to move the plunger of solenoid 20 in the locking direction and the time it takes to bring element 22 up to a desired temperature. The solenoid 20 is actuated within approximately 500 milliseconds to lock or unlock the door, while the heating element 22 requires approximately 10 seconds to begin generating heat. Since the solenoid 20 is actuated within approximately 500 milliseconds and the heating element 22 is actuated within approximately 10 seconds, the heating element 22 only gets activated for a short period of time, which is not long enough for the heating element 22 to begin generating heat. Once the solenoid 20 is actuated by closing driver 18*a* and opening driver 18*b*, the drivers 18*a*, 18*b* are immediately placed in an off state, thereby releasing the solenoid 20. As such, the heating element 22 is not energized long enough to begin generating heat.

In a second example, when the user wishes to unlock the door in the vehicle, the microprocessor 16 closes driver 18*b* and leaves driver 18*a* open. In doing so, the power source 14 provides a flow of current through the solenoid 20 to move its plunger in a second direction, thereby unlocking the door. With this configuration, current flows through driver 18*b* to ground, via the solenoid 20, unlocking the door in the vehicle. In this case, current is not flowing through heating element 22 because driver 18*a* is open thereby placing ground at both sides of element 22. Once the solenoid 20 is operated to unlock the door, drivers 18*a*, 18*b* are placed back into an off state, thereby turning the solenoid 20 off.

Various methods can be used to enable the solenoid 20 to either lock or unlock the door. For example, the user can manually lock or unlock the door from command buttons located inside the vehicle. The user may also use a key or a keyless entry remote controller to lock or unlock the door.

In a third example, when the user desires to turn the heating element 22 on, the microprocessor 16 applies the same potential across the relay coils of drive circuits 18*a*, 18*b* to operate both drivers. In doing so, the power source 14 provides a flow of current through the driver 18*a* to heating element 22, enabling the heating element 22 to begin generating heat. With this configuration, current flows through driver 18*a* and element 22 to ground. No current is flowing through the solenoid 20 at this time since the same potential from source 14 appears at both sides of the solenoid's coil.

The microprocessor 16 switches the drivers 18*a*, 18*b* back to their off position after the solenoid 20 is turned on. As for heating element 22, the microprocessor 16 keeps the drivers 18*a*, 18*b* in a closed state until the user decides to turn the heating element 22 off. As the heating element 22 is being activated, there is no effect on the solenoid 20.

FIG. 2 illustrates a table showing a combination of polarity arrangements for driver circuits 18*a*, 18*b* and the resulting effect of each combination of relay driver states. Specifically, the effects include the functions of the solenoid 20 and/or the heating element 22. The combinations are shown as 0s, which represent an off state, and 1s, which represent an on state. When the combination is 00, drivers 18*a*, 18*b*, respectively, are off, thereby placing ground potential at the driver outputs. As such, no current is flowing through the solenoid 20 or the heating element 22. This is referred to as a NO FUNCTION effect. When the combination is 01, driver 18*a* is off and driver 18*b* is on, thereby moving the plunger at solenoid 20 in an unlocking direction. This is referred to as an UNLOCK effect. When the combination is 10, driver 18*a* is on and driver 18*b* is off. This combination moves the plunger of solenoid 20 in a locking direction for the door and actuating the heating element 22. This is referred to as a LOCK and HEAT effect. When the state combination is 11, the drivers 18*a*, 18*b* are respectively closed. In this case, drivers 18*a*, 18*b* have a positive polarity. As such, only the heating element 22 is enabled. The solenoid 20 remains at its off state since no current flows through its coil. It should be understood that as the heating element 22 is generating heat or as the drivers 18*a*, 18*b* remain in a closed state, there is no effect on the solenoid 20.

In a fourth example, when the user wishes to lock or unlock the door and then turn on the side mirror defroster, the microprocessor 16 switches the polarities of the outputs of drivers 18*a*, 18*b* in a combination of polarity arrangements to enable the functions of both the solenoid 20 and the heating element 22. Initially, the microprocessor 16 has the drivers 18*a*, 18*b* off, thereby placing the solenoid 20 and the heating element 22 to a NO FUNCTION effect (00). The microprocessor 16 then sets the polarity of each driver output to operate the plunger of solenoid 20 to either a LOCK or UNLOCK state, accordingly, depending on the user's decision. Within approximately 500 milliseconds, the microprocessor 16 operates each of the drivers 18*a*, 18*b*, thereby enabling the heating element 22 to begin generating heat. The drivers 18*a*, 18*b* remain closed until the user wishes to turn the side mirror defroster off.

In another aspect of the fourth example, when the user wishes to turn the side mirror defroster on before locking or unlocking the door, the microprocessor 16 operates the relay drivers 18*a*, 18*b*, thereby enabling the heating element 22 to begin generating heat. The drivers 18*a*, 18*b* remain in an on state until the user wishes to lock or unlock the door. If the user decides to lock or unlock the door in the middle of heating up the heating element 22, the polarity of the outputs of drivers 18*a*, 18*b* are quickly changed to lock or unlock the door. Once the solenoid 20 operates to lock or unlock the door, the drivers 18*a*, 18*b* are quickly positioned back into an on state, thereby providing current back to the heating element 22. The transition between enabling the function of the heating element 22 to enabling one of the functions of the solenoid 20 and back to enabling the function of the heating element 22 is quick enough that there is a negligible effect on either function.

It should be understood that the heating element 22 can be used to heat up any type of mechanism, such as, for example, a rear window defroster or the seats in the vehicle. The heating element 22 can also be replaced with any type of mechanism, such as, for example, a diode or another drive circuit. It should also be understood that the functions of the solenoid 20 can be extendable to other functions such as, for example, opening and closing a power sliding door or a power window of the vehicle.

The present invention requires only two drive circuits to enable the two functions of the solenoid 20 and the function of the heating element 22. This eliminates the need for an additional drive circuit to drive the heating element 22 independently. As such, cost of production is decreased.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for enabling a first plurality of functions via electrical signals comprising:

providing a second plurality of drive circuits for providing the electrical signals, wherein the second plurality is less than the first plurality;

selecting the first plurality of functions such that at least one of the functions can be enabled faster than at least one other function; and using at least one of the drive circuits to enable both the at least one function and the at least one other function.

2. A method for enabling at least three functions via voltage signals, the method comprising:

providing first and second drive circuits for providing the voltage signals;

selecting the at least three functions such that at least a first function can be enabled faster than a second function; and using one of the drive circuits to enable both the first and second functions.

3. The method of claim 2 wherein the at least three functions include unlocking a vehicle door, locking a vehicle door and heating a vehicle mirror, wherein the vehicle door may be locked faster than the vehicle mirror can be heated.

4. A driver system for enabling a first plurality of functions comprising:

a second plurality of driver circuits less than the first plurality of functions, each driver circuit operative to generate at an output thereof one of two possible signal polarities depending on a state of the driver circuit; and a controller operative to recognize requests for enabling at least one of the first plurality of functions and to place the second plurality of driver circuits in states such that the driver circuit outputs will have appropriate sets of signal polarities for enabling the at least one function requested and such that one of the sets enables two of the first plurality of functions wherein one of the two functions can be enabled faster than the other.

5. The system of claim 4 wherein each driver circuit comprises an electromagnetic relay having a coil coupled to the controller and a transfer contact coupled between the driver circuit output and a voltage source.

6. A driver system for actuating a solenoid plunger in first and second directions and for supplying current to a resistive heating element, the system comprising:

a microprocessor-based controller having a first input for receiving a request for actuating the solenoid plunger in a first direction, a second input for receiving a request for actuating the solenoid plunger in a second direction, a third input for receiving a request for supplying current to the resistive heating element, and first and second outputs;

a voltage source having first and second polarities;

first and second relay drivers, each having an output and an actuating coil with a first end coupled to one of the first and second outputs of the controller and a second end coupled to the voltage source and a transfer contact configured to place a voltage of a first polarity on the driver output when the relay driver is actuated and a voltage of a second polarity on the driver output when the relay driver is not actuated;

an actuating coil for the solenoid plunger coupled between the outputs of the first and second relay drivers; and the resistive heating element coupled between the output of the first relay driver and the second polarity of the voltage source.

* * * * *